US005520109A

United States Patent [19]

Meschi

[11] Patent Number: 5,520,109

[45] Date of Patent: May 28, 1996

[54] PRINTING APPARATUS FOR CONTINUOUS ROTARY PRINTING, IN PARTICULAR SUITABLE FOR HIGH SPEED AND INTERMITTENT PRINTING

[75] Inventor: Luciano Meschi, Rosignano Marittimo, Italy

[73] Assignee: Industria Grafica Meschi S.r.l., Livorno, Italy

[21] Appl. No.: 320,410

[22] Filed: Oct. 3, 1994

[30] Foreign Application Priority Data

Oct. 1, 1993 [IT] Italy ..... FI93A0191

[51] Int. Cl.[6] ..... B41F 13/34; B41F 31/30

[52] U.S. Cl. ..... 101/247; 101/352

[58] Field of Search ..... 101/148, 351, 101/352, 247, 363, 137, 139, 140, 143, 144, 145, 182, 184, 185

[56] References Cited

U.S. PATENT DOCUMENTS

| | | | |
|---|---|---|---|
| 2,982,204 | 5/1961 | Roehm | 101/247 |
| 5,088,407 | 2/1992 | Helm et al. | 101/350 |
| 5,148,746 | 9/1992 | Fuller et al. | 101/425 |
| 5,259,313 | 11/1993 | Gibson | 101/425 |

FOREIGN PATENT DOCUMENTS

| | | |
|---|---|---|
| 0646458 | 4/1995 | European Pat. Off. . |
| 2140955 | 1/1973 | France . |
| 2411705 | 7/1979 | France . |
| 3124764 | 1/1983 | Germany . |
| 17661 | 6/1915 | United Kingdom . |
| 2068298 | 8/1981 | United Kingdom . |

*Primary Examiner*—J. Reed Fisher
*Attorney, Agent, or Firm*—Browdy and Neimark

[57] ABSTRACT

Improved apparatus for rotary printing of a strip of paper (1) or similar material, comprising a printing roller (2) provided with a cliché (3) brought into contact with a back pressure roller (4) and a screened roller (5) to quickly interrupt and resume the printing of the paper (1), said means comprising a support (20) to which the printing roller (2) is rotatingly connected and which is, in turn, rotatingly connected to a fixed pivot (21) eccentric with respect to the printing roller (2) and around which rotation occurs by means of an actuator (22). Washing means (15) are also provided for the cliché (3) and a mobile support (30) of the ink roller (6) which allows it to be distanced from the screened roller (5) so as to create a space (8) which promotes the formation of a film of ink on the screened roller (5) itself suitable to keep it damp and prevent drying. (FIG. 2 )

2 Claims, 2 Drawing Sheets

PRINTING APPARATUS FOR CONTINUOUS ROTARY PRINTING, IN PARTICULAR SUITABLE FOR HIGH SPEED AND INTERMITTENT PRINTING

The present invention generally relates to the field of printing apparatuses and more precisely it relates to improved apparatus for continuous rotary typographic printing, in particular suitable for high speed and intermittent printing.

In existing printing apparatuses, in particular those of a rotary typographic type, the material to be printed, normally a continuous strip of paper, is brought into contact with a printing roller supporting a cliché on which the portions which print the signs or characters on the paper are raised. The paper is pressed against the cliché of the printing roller by a pressure roller and the cliché, before entering in contact with the paper to be printed on, is dampened with ink on the raised portions.

According to printing techniques which at present are consolidated and improved, the cliché is dampened with ink directly by an ink roller which dips in rotation in the ink and comes into contact with an intermediate roller, called a "screened" roller, which is able to hold only a quantity of ink sufficient to dampen one pass of the cliché on the paper. The ink is spread uniformly on the intermediate roller thanks to its screened surface against which the ink roller engages by pressing along a common generatrix. The pressure between the ink roller and the screened roller determines the quantity of ink which remains on the latter, more specifically inside the very thickly-woven screen on its surface.

Rotary printing is used for producing a large number of identical pages corresponding to the cliché used. At the conclusion of printing, or at a break in printing, the printing roller is disengaged from the pressure roller and from the screened roller in order to make the substitution of the cliché possible. The means for disengagement are normally manually or automatically operated sliding means, and they set into motion a slow translation. The cliché are commonly made of copper, zinc, or flexible plastic material, and in this last case, the corresponding printing is called flexography.

For some types of printing, for example in the case of data printers, the problem of being able to associate the data printer with an intermittent typographic printer, superimposing the print of the latter on the former, on the same sheets of paper, is strongly felt. In fact, data are normally printed on paper by means of a laser printer or the like which is very suitable to the printing of characters varying from one sheet to the next. Currently, data is superimposed on a second printing already comprising the frames, explanatory writing, letter heads, figures etc. common to all the sheets.

In order to be able to contemporaneously carry out the two printings without any overloading, and, therefore, to make the printing of data faster, the second printing can be conveniently carried out with separate typographical means. Therefore, downstream from the data printer, an apparatus for rotary printing, or a plurality of such apparatuses in series, can be provided for. In the latter case, the paper crosses all the apparatuses in the series, and a centralized control system provides for the closing of the printing roller corresponding to the printing one wishes to have superimposed on the data.

Currently, however, combined apparatuses of this type are not without inconveniences, and therefore are still not widely used. In fact, a first inconvenience is that the achievable closing speed of the printing roller is not great enough to allow sufficiently fast suspension and resumption of printing. A second inconvenience is caused by the fact that the other machines or other printing apparatuses comprising printing rollers and screened rollers not in use, during possible and perhaps long waiting periods before re-engagement, are subject to drying of the ink.

Therefore, at present, the above-mentioned cases of printing of variable data with the superimposition of invariable print, as in the case of invoices, bills, bank statements, etc., are generally approached in a traditional way, i.e. printing the data on pre-printed paper with upstream and separate typographic printing.

The object of the present invention is to provide an improved apparatus for rotary typographic printing of a strip of paper or similar material, in particular suitable for high-speed and intermittent printing, able to allow for a practically instantaneous closing of the printing roller on the paper and also able to withstand periods of even long inactivity, without presenting the inconvenience of drying of the ink.

This object is accomplished by the improved printing apparatus according to the invention, characterized in that it comprises means for disengagement of the printing roller from the screened roller and the pressure roller comprising a first support, to which the printing roller is rotatingly connected, which is itself connected to a fixed pivot that is eccentric with respect to the printing roller. The first support is connected to an actuator of rotation around the fixed pivot, able to intervene on the support with quick motion producing the disengagement or re-engagement of the printing roller. A second mobile support on fixed guides is also provided to which an ink roller is rotatingly connected, so that the space existing between it and the screened roller can be varied and the screened roller can thus be dampened to a greater degree with ink in case of long breaks in printing. Finally, means for washing the printing roller during said breaks of printing are provided.

Further characteristics and advantages of the improved printing apparatus according to the invention will become more apparent in the following description of one of its embodiments, given as an example and not limitative, with reference to the attached drawings in which.

Figure 1:
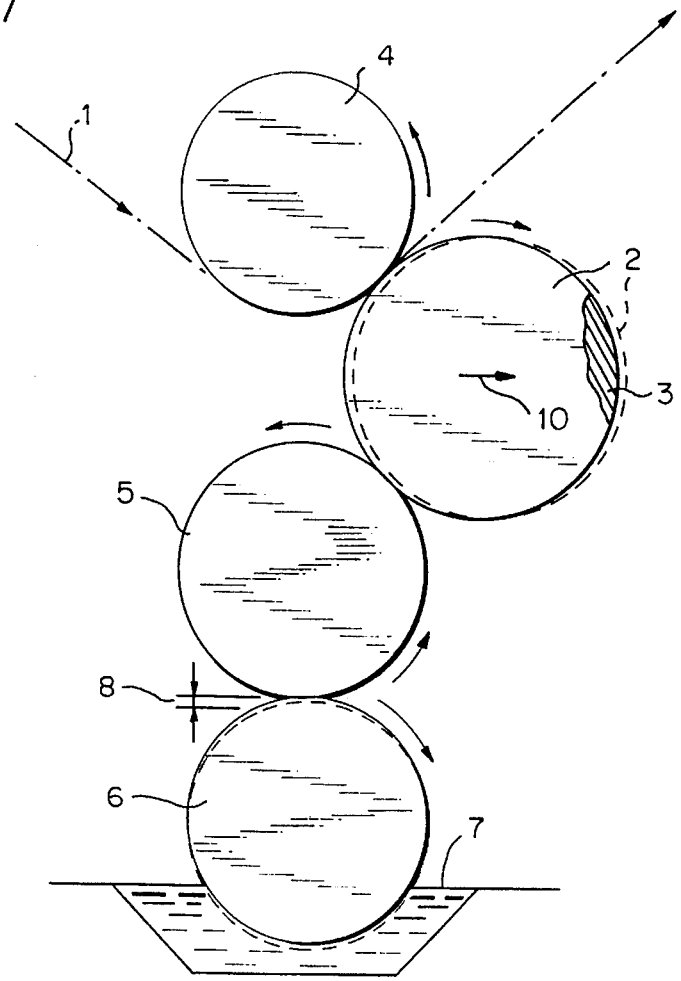
FIG. 1 shows a schematic transversal sectional view of an improved printing apparatus according to the invention.

With reference to FIG. 1, a machine for rotary typographic printing of a strip of paper 1 comprises a printing roller 2 on the circumferential surface of which a cliché 3 is present. The term cliché as recited herein and in the claims means the same as printing plate. Printing roller 2 is in contact with a pressure roller 4 which presses paper 1 against the cliché 3 and against a screened roller 5 suitable to dampen cliché 3, before it enters into contact with the paper, with ink deposited on it by an ink roller 6 which dips, in continuous rotation, in an ink well 7 located below it. The pressure existing between screened roller 5 and ink roller 6 makes it so that only the quantity of ink sufficient for the printing remains on roller 5, the excess ink being substantially squeezed backwards and therefore not able to cross the space existing between ink roller 6 and screened roller 5.

According to the invention, printing roller 2 is subject to sudden disengaging movement in the direction of the arrow 10 in order to discontinue contact with screened roller 5 and pressure roller 4 each time printing must be interrupted, i.e., the impression on paper 1 of the signs present on cliché 3 must be suspended. In the direction opposite arrow 10, the re-engagement of printing roller 2 against the rollers 4 and 5 occurs in an equally sudden manner for the resumption of printing on paper 1 which, in the meantime, has not stopped sliding on pressure roller 4.

Furthermore, in the case of long breaks in printing, to keep the ink present on screened roller 5 from drying, means are provided for the lowering of ink roller 6 to create a space 8 between it and screened roller 5, thus creating a veil of ink which, no longer being squeezed by roller 6, covers roller 5 preventing said drying of the ink present on the screen. Finally, a washing device 15 is provided at the height of printing roller 2 to engage on the periphery of the roller and wash the cliché in the case of long breaks in printing.

Figure 2:
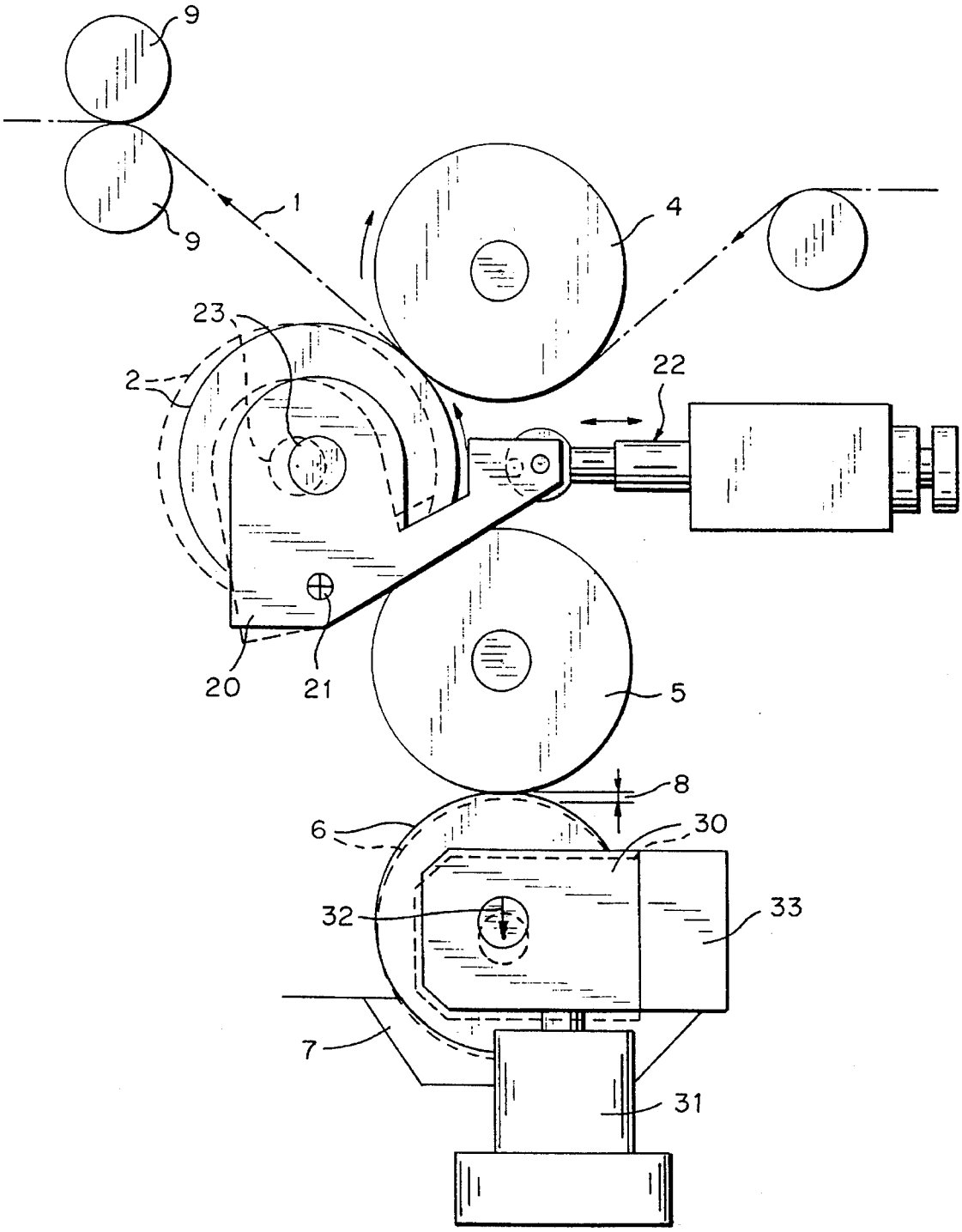
FIG. 2 shows a sectional view of the apparatus of FIG. 1 with means for the movement of the printing roller and ink roller illustrated in greater detail.

In FIG. 2, the means for movement of roller 2 and roller 6 are visible in greater detail. More precisely, printing roller 2 is rotatingly connected to a support 20 which is in turn rotatingly connected to a fixed pivot 21 eccentric with respect to axis 23 of printing roller 2. An actuator 22 causes the rotation of support 20 around pivot 21 making it so that the printing roller 2 rotates also around pivot 21 and follows a circular path sufficient to cause the disengagement of cliché 3 from pressure roller 4 and from screened roller 5. The movement of disengagement, which substantially takes place like a rocker arm, is much more easily controlled by means of a single actuator 22 and without the necessity to use sliding guides subject to friction and misalignment. For this reason an almost instantaneous movement of disengagement and re-engagement of printing roller 2 is permitted with the possibility of intermittent printing at high frequency with paper which proceeds at a high speed without stopping. This makes it possible to use more than one apparatus according to the invention placed in a series and each able to carry out a different printing. The strip of paper, which crosses all the apparatuses, is therefore subject to being printed on by only one (in some cases two) of the apparatuses, with the others waiting to intervene, upon signaling by a central processor, for the passing of predefined portions of strip to be printed.

With further reference to FIG. 2, the means which allow for the variation of the space existing between screened roller 5 and ink roller 6 comprise a support 30 which can slide in parallel fixed guides 33 and to which roller 6 is rotatingly connected. Support 30, moved by an actuator 31, allows for a single small movement in the direction of the arrow 32 suitable to create a space 8 sufficient to cause the formation of a film of ink on roller 5. The movement of roller 6 is not necessarily sudden, in that the formation of the film of ink to avoid drying is not necessary when the break in printing is very short. Upon resumption of printing, after a long break (at least several minutes), ink roller 6 resumes its original position reducing space 8 to the minimum indispensable to assure the dampening of roller 5 only inside the screen for holding the ink. Only after this operation has been completed and screened roller 5 has made at least one complete rotation, is it possible to resume intermittent or continuous printing through the re-engagement of printing roller 2 against pressure roller 4 and screened roller 5.

Figure 3:
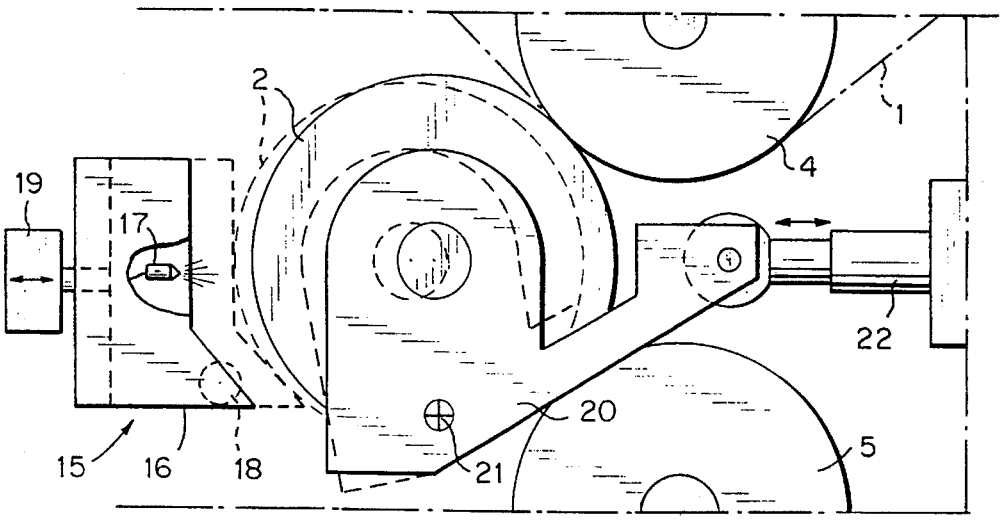
FIG. 3 shows a schematic view of washing means for the printing roller.

Finally, as regards the washing means 15, as shown in FIG. 3, they comprise a mobile support 16 inside which sprayers 17 and collection means 18 are provided for the water which is then recirculated. Means 19 for the translation of the support 16 towards cliché 3 of printing roller 2 are provided to allow its washing. This operation occurs every time in case of breaks long enough to cause drying of the ink which dampens the cliché 3.

All the above-described operations of the movement of printing roller 2 and ink roller 6 and washing means 15 are controlled by a central processor which, by means of sensors and encoders, for example placed on the dragging rollers 9 for paper 1 (FIG. 2), continuously controls printing, sending signals to the various actuators in synchronism with the position of the paper.

The improved printing apparatus according to the invention thus accomplishes the above-mentioned objects, allowing for an intermittent printing of paper at a high speed, with a high frequency of interruptions and resumptions of printing, as well as preventing the drying of the ink on the surface of the printing means in case of long breaks in printing. In particular, it is suited for being introduced downstream from a data printing machine having more than one unit in a series. It is thus possible to print variable data and invariable signs together, beginning with virgin paper and with high flexibility of movements, without the necessity of stopping the paper.

I claim:

1. In a rotary typographic printing apparatus, for a strip of printable material having a printing roller (2) holding a printing plate (3) and having a printing roller axis;

a pressure roller (4) pressing said strip against said printing roller;

a screened roller (5) in contact with said printing roller and dampening said printing roller; and an ink roller (6) partially dipped in an ink well (7) and dampening said screened roller;

an improvement for allowing high-speed and intermittent combination printing of both changeable data and fixed images, the improvement comprising:

means for intermittent disengagement of said printing roller from said pressure roller and from said screened roller at the completion of a printing phase, said means for intermittent disengagement further comprising:

a first support (20) to which said printing roller is rotatingly connected for rotation of said printing roller about said printing roller axis;

a fixed pivot (21) about which said first support intermittently rotates, said fixed pivot being eccentric with respect to said printing roller axis (23);

an actuator (22) of rotation around said fixed pivot, said actuator being connected to said first support to rotate said first support;

a mobile second support (30) on which said ink roller is rotatingly connected, said second support being movable on fixed guides (33) such that a space (8) between said ink roller and said screened roller can be varied, whereby the screened roller can be dampened with ink to a greater degree in case of long breaks in printing, and said second support and said fixed guides together constitute a means for preventing drying of an ink film; and means (15) for washing said printing roller in the case of long breaks.

2. The improvement according to claim 1, wherein means for washing said printing roller comprises:

a support (16) provided with translation means for said printing roller;

sprayers (17); and means (18) for collecting and recirculating washing water.

* * * * *